US008464789B2

(12) United States Patent
Banerjee et al.

(10) Patent No.: US 8,464,789 B2
(45) **Date of Patent: *Jun. 18, 2013**

(54) PROCESS FOR ENHANCED PRODUCTION OF HEAVY OIL USING MICROWAVES

(75) Inventors: Dwijen K. Banerjee, Owasso, OK (US); John L. Stalder, Calgary (CA); Thomas J. Wheeler, Houston, TX (US); Wayne Reid Dreher, Jr., College Station, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/154,822

(22) Filed: Jun. 7, 2011

(65) Prior Publication Data

US 2011/0253367 A1 Oct. 20, 2011

Related U.S. Application Data

(63) Continuation-in-part of application No. 12/239,051, filed on Sep. 26, 2008, now Pat. No. 7,975,763.

(60) Provisional application No. 61/466,349, filed on Mar. 22, 2011, provisional application No. 61/382,696, filed on Sep. 14, 2010.

(51) Int. Cl.
*E21B 43/24* (2006.01)

(52) U.S. Cl.
USPC .... 166/248; 166/65.1; 166/272.1; 166/272.3; 166/272.6; 166/272.7; 166/302

(58) Field of Classification Search
None
See application file for complete search history.

(56) References Cited

U.S. PATENT DOCUMENTS

| | | | |
|---|---|---|---|
| 4,094,798 | A | 6/1978 | Tate et al. |
| RE30,738 | E | 9/1981 | Bridges et al. |
| 4,457,365 | A | 7/1984 | Kasevich et al. |
| 4,485,868 | A | 12/1984 | Sresty et al. |
| 4,620,593 | A | 11/1986 | Haagensen |
| 4,638,863 | A | 1/1987 | Wilson |
| 4,700,716 | A | 10/1987 | Kasevich et al. |
| 4,817,711 | A | 4/1989 | Jeambey |
| 4,912,971 | A | 4/1990 | Jeambey |
| 5,082,054 | A | 1/1992 | Kiamanesh |
| 5,109,927 | A | 5/1992 | Supernaw et al. |
| 5,321,222 | A | 6/1994 | Bible et al. |
| 5,521,360 | A | 5/1996 | Johnson et al. |
| 5,899,274 | A | 5/1999 | Frauenfeld et al. |

(Continued)

FOREIGN PATENT DOCUMENTS

| | | |
|---|---|---|
| GB | 0896407 | 5/1962 |
| JP | 5112004104 | 10/1976 |
| WO | 2007/081493 A2 | 7/2007 |

OTHER PUBLICATIONS

Deutsch, C.V. and McLennan, J.A., Guide to SAGD (Steam Assisted Gravity Drainage) Reservoir Characterization Using Geostatistics, 2005, Centre for Computational Geostatistics. cited by other.

*Primary Examiner* — George Suchfield
(74) *Attorney, Agent, or Firm* — ConocoPhillips Company

(57) ABSTRACT

A process for utilizing microwaves to heat $H_2O$ within a subterranean region wherein the heated $H_2O$ contacts heavy oil in the subterranean region to lower the viscosity of the heavy oil and improve production of the heavy oil.

31 Claims, 4 Drawing Sheets

U.S. PATENT DOCUMENTS

| | | | | |
|---|---|---|---|---|
| 6,012,520 | A | 1/2000 | Yu et al. | |
| 6,544,411 | B2 | 4/2003 | Varadaraj | |
| 6,814,141 | B2 | 11/2004 | Huh et al. | |
| 7,073,577 | B2 | 7/2006 | Yu | |
| 7,091,460 | B2 | 8/2006 | Kinzer | |
| 7,461,693 | B2 | 12/2008 | Considine et al. | |
| 7,484,561 | B2 | 2/2009 | Bridges | |
| 7,677,673 | B2 | 3/2010 | Tranquilla et al. | |
| 7,975,763 | B2 * | 7/2011 | Banerjee et al. | 166/248 |
| 8,176,982 | B2 * | 5/2012 | Gil et al. | 166/272.1 |
| 2005/0199386 | A1 | 9/2005 | Kinzer | |
| 2007/0131591 | A1 | 6/2007 | Pringle | |
| 2007/0289736 | A1 | 12/2007 | Kearl et al. | |
| 2008/0073079 | A1 | 3/2008 | Tranquilla et al. | |
| 2009/0071648 | A1 | 3/2009 | Hagen et al. | |
| 2009/0139716 | A1 | 6/2009 | Brock et al. | |
| 2010/0294488 | A1 * | 11/2010 | Wheeler et al. | 166/248 |
| 2010/0294489 | A1 * | 11/2010 | Dreher et al. | 166/248 |
| 2012/0061080 | A1 * | 3/2012 | Sultenfuss et al. | 166/302 |

* cited by examiner

PROCESS FOR ENHANCED PRODUCTION OF HEAVY OIL USING MICROWAVES

CROSS-REFERENCE TO RELATED APPLICATIONS

This application is a continuation-in-part application which claims benefit under 35 USC §120 to U.S. application Ser. No. 12/239,051 filed Sep. 26, 2008 entitled "PROCESS FOR ENHANCED PRODUCTION OF HEAVY OIL USING MICROWAVES," incorporated herein in their entirety and a non-provisional application which claims benefit under 35 USC §119(e) to U.S. Provisional Application Ser. No. 61/466,349 filed Mar. 22, 2011 entitled "METHOD OF RAISING SUBSURFACE TEMPERATURE OF HEAVY OIL FOR IN SITU UPGRADING" and U.S. Provisional Application Ser. No. 61/382,696 filed Sep. 14, 2010 entitled "RADIO FREQUENCY ENHANCED SAGD and ES SAGD" which is incorporated herein in its entirety.

STATEMENT REGARDING FEDERALLY SPONSORED RESEARCH OR DEVELOPMENT

None.

FIELD OF THE INVENTION

The present invention relates generally to a process for recovering heavy oil from a reservoir. In particular, the invention provides for utilizing microwaves to heat $H_2O$ which interacts with the heavy oil in the reservoir to lower the viscosity of the heavy oil.

BACKGROUND OF THE INVENTION

Heavy oil is naturally formed oil with very high viscosity but often contains impurities such as sulfur. While conventional light oil has viscosities ranging from about 0.5 centipoise (cP) to about 100 cP, heavy oil has a viscosity that ranges from 100 cP to over 1,000,000 cP. Heavy oil reserves are estimated to equal about fifteen percent of the total remaining oil resources in the world. In the United States alone, heavy oil resources are estimated at about 30.5 billion barrels and heavy oil production accounts for a substantial portion of domestic oil production. For example, in California alone, heavy oil production accounts for over sixty percent of the states total oil production. With reserves of conventional light oil becoming more difficult to find, improved methods of heavy oil extractions have become more important. Unfortunately, heavy oil is typically expensive to extract and recovery is much slower and less complete than for lighter oil reserves. Therefore, there is a compelling need to develop a more efficient and effective means for extracting heavy oil.

Viscous oil that is too deep to be mined from the surface may be heated with hot fluids or steam to reduce the viscosity sufficiently for recovery by production wells. One thermal method, known as steam assisted gravity drainage (SAGD), provides for steam injection and oil production to be carried out through separate wellbores. The optimal configuration is an injector well which is substantially parallel to and situated above a producer well, which lies horizontally near the bottom of the formation. Thermal communication between the two wells is established and, as oil is mobilized and produced, a steam chamber or chest develops. Oil at the surface of the enlarging chest is constantly mobilized by contact with steam and drains under the influence of gravity.

Hydrocarbons do not typically couple well with MW/RF radiation. This is due to the fact that these molecules do not possess a dipole moment. However, heavy crude oils are known to possess asphaltenes which are molecules with a range of chemical compositions. Asphaltenes are often characterized as polar, metal containing molecules. These traits make them exceptional candidates for coupling with radio frequencies. By targeting these molecules with RF radiation, localized heat will be generated which will induce a viscosity reduction in the heavy oil. Through the conductive heating of the heavy crude oil or bitumen in place, a potential decrease in the startup time of a steam assisted gravity drainage (SAGD) operation or expanding solvent steam assisted gravity drainage (ES-SAGD) operation may be experienced. This may also lead to decreases in the amount of water required and green house gas emissions produced which will have positive economic and environmental impacts on operations.

Additionally, the use of MW/RF radiation in the presence of an alternate heat source can decrease the activation energy required for converting and breaking down carbon-carbon bonds. This synergistic effect can lead to the in situ upgrading of heavy crude oils by breaking down molecules which are known to significantly increase the viscosity of the crude oil. However, the use of RF frequencies in a reservoir is not straight forward, nor is the selection of the appropriate RF frequency.

There are several patents on the improvements to SAGD operation. U.S. Pat. No. 6,814,141 describes applying vibrational energy in a well fracture to improve SAGD operation. U.S. Pat. No. 5,899,274 teaches addition of solvents to improve oil recovery. U.S. Pat. No. 6,544,411 describes decreasing the viscosity of crude oil using ultrasonic source. U.S. Pat. No. 7,091,460 claims in situ, dielectric heating using variable radio frequency waves.

In a recent patent publication (U.S. Patent Publication 20070289736/US-A1, filed May 25, 2007), it is disclosed to extract hydrocarbons from a target formation, such as a petroleum reservoir, heavy oil, and tar sands by utilizing microwave energy to fracture the containment rock and for liquification or vitalization of the hydrocarbons.

In another recent patent publication (US Patent Publication 20070131591/US-A1, filed Dec. 14, 2006), it is disclosed that lighter hydrocarbons can be produced from heavier carbon-base materials by subjecting the heavier materials to microwave radiations in the range of about 4 GHz to about 18 GHz. This publication also discloses extracting hydrocarbons from a reservoir where a probe capable of generating microwaves is inserted into the oil wells and the microwaves are used to crack the hydrocarbons with the cracked hydrocarbon thus produced being recovered at the surface.

Despite these disclosures, it is unlikely that direct microwave cracking or heating of hydrocarbons would be practical or efficient. It is known that microwave energy is absorbed by a polar molecule with a dipole moment and bypasses the molecules that lack dipole moment. The absorption of the microwave energy by the polar molecule causes excitation of the polar molecule thereby transforming the microwave energy into heat energy (known as the coupling effect). Accordingly, when a molecule with a dipole moment is exposed to microwave energy it gets selectively heated in the presence of non-polar molecules. Generally, heavy oils comprise non-polar hydrocarbon molecules; accordingly, hydrocarbons would not get excited in the presence of microwaves.

Additionally, while the patent publication above claims to break the hydrocarbon molecules, the energy of microwave photons is very low relative to the energy required to cleave a hydrocarbon molecule. Thus, when hydrocarbons are exposed to microwave energy, it will not affect the structure of a hydrocarbon molecule. (See, for example, "Microwave Synthesis", CEM Publication, 2002 by Brittany Hayes).

There exists a need for an enhanced process that couples the use of non-microwave RF radiation to produce an upgraded hydrocarbon within a production well within a bitumen or heavy oil formation.

BRIEF SUMMARY OF THE DISCLOSURE

A process of injecting $H_2O$ and an activator into a subterranean region through a first wellbore of a steam assisted gravity drainage operation. Microwaves are then introduced into the region at a frequency sufficient to excite the $H_2O$ and the activator molecules and increase the temperature of at least a portion of the $H_2O$ and activator within the region to produce heated $H_2O$ and a heated activator. A portion of the heavy oil in the region is heated by contact with the heated $H_2O$ and the heated activator to produce heated heavy oil. Heated heavy oil is then produced through a second wellbore of the steam assisted gravity drainage operation enabling recovery of heavy oil with the steam assisted gravity drainage operation from a subterranean region. In this embodiment a portion of the $H_2O$ is injected as steam and the steam contacts with at least a portion of the heavy oil in the region so as to heat the portion of the heavy oil and reduce its viscosity so that it flows generally towards the second wellbore.

In a second embodiment the process describes injecting liquid $H_2O$ and an activator into a region through a first wellbore of a steam assisted gravity drainage operation. Frequencies of less than 3,000 MHz are then introduced into a subterranean region at a frequency sufficient to excite the liquid $H_2O$ molecules and activator molecules and increase the temperature of at least a portion of the liquid $H_2O$ and activator within the region to produce heated gaseous $H_2O$ and heated activator. At least a portion of the heavy oil in the region is then heated by contact with the heated gaseous $H_2O$ and the heated activator to produce heated heavy oil. Heated heavy oil is then produced through a second wellbore of the steam assisted gravity drainage operation enabling recovery of the heavy oil with the steam assisted gravity drainage operation from the subterranean region. In this embodiment a portion of the $H_2O$ is injected as steam and the steam contacts with at least a portion of the heavy oil in the region so as to heat the portion of the heavy oil and reduce its viscosity so that it flows generally towards the second wellbore. Additionally, a catalyst is injected into the region such that the catalyst contacts the heated heavy oil thereby producing an upgraded heavy oil.

In yet another embodiment the process begins by injecting $H_2O$ and an activator into a subterranean region through an injection wellbore of a steam assisted gravity drainage operation. A frequency of less than 3,000 MHz is then introduced into the region at a frequency sufficient to excite the $H_2O$ and activator molecules and increase the temperature of at least a portion of the $H_2O$ and activator within the region to produce heated $H_2O$ and heated activator. At least a portion of the bitumen was heated to below 3000 cp in the region by contact with the heated $H_2O$ and the heated activator to produce a heated heavy oil and an imposed pressure differential between the injection wellbore and a production wellbore. Heavy oil is then produced through the production wellbore of the steam assisted gravity drainage operation. In this embodiment heavy oil is recovered from the subterranean region with the steam assisted gravity drainage operation. Additionally, the injection wellbore and the production wellbore are from 3 meters to 7 meters apart and the injection wellbore is located higher than the production wellbore. Also, a portion of the $H_2O$ is injected as steam and the steam contacts with at least a portion of the heavy oil in the region so as to heat the portion of the heavy oil and reduce its viscosity so that it flows generally towards the second wellbore. Furthermore, a catalyst is injected into the region such that the catalyst contacts the heated heavy oil thereby producing an upgraded heavy oil.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

In this description, the term water is used to refer to $H_2O$ in a liquid state and the term steam is used to refer to $H_2O$ in a gaseous state.

Figure 1:
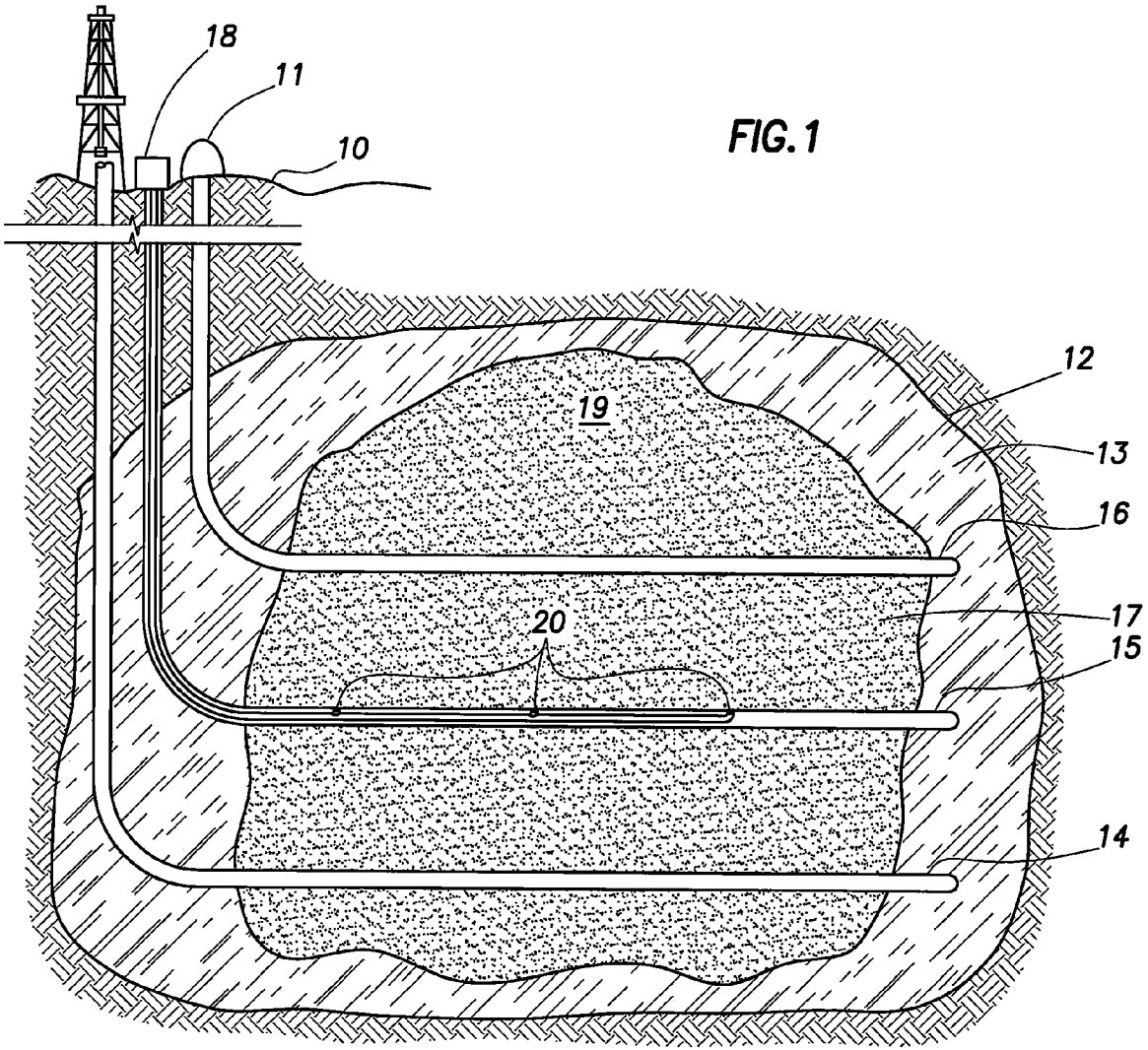
FIG. 1 is a schematic diagram illustrating a heavy oil heating process, wherein wave guides are used to introduce the microwaves to the reservoir.

Turning now to FIG. 1, wellbores 14, 15 and 16 are illustrated. Wellbore 14 extends from the surface 10 into a lower portion of subterranean region 12. Wellbore 16 extends from the surface 10 into subterranean region 12 and generally will be higher than wellbore 14. Wellbore 16 will be used to inject $H_2O$ and an activator and it is preferred that it is located higher than wellbore 14 so that when the injected $H_2O$ and the heated activator heats the heavy oil, the heavy oil will flow generally towards wellbore 14, which is used to extract the heavy oil from the reservoir. In one embodiment a portion of the $H_2O$ is injected as steam and the steam contacts with at least a portion of the heavy oil in the region so as to heat the portion of the heavy oil and reduce its viscosity so that it flows generally towards the second wellbore. Wellbore 15 is used to introduce microwaves to the reservoir and it is preferred that wellbore 15 be located intermittent to wellbores 14 and 15; although, other arrangements are possible. The activator this embodiment the activator is heated by the frequencies used to heat the injected water.

By choosing specific activators to inject into the wellbore, one skilled in the art would have the requisite knowledge to select the exact frequency required to achieve maximum heating of the activator. Therefore the current method eliminates the need to arbitrarily generate variable frequencies which may or may not be able to be efficiently absorbed.

Examples of activators include ionic liquids that may include metal ion salts and may be aqueous. Asymmetrical compounds selected for the microwave energy absorbing substance provide more efficient coupling with the frequencies than symmetrical compounds. In some embodiments, ions forming the energy absorbing substance include divalent or trivalent metal cations. Other examples of activators suitable for this method include inorganic anions such as halides. In one embodiment the activator could be a metal containing compound such as those from period 3 or period 4. In yet another embodiment the activator could be a halide of Na, Al, Fe, Ni, or Zn, including $AlCl_4^-$, $FeCl_4^-$, $NiCl_3^-$, $ZnCl_3^-$ and combinations thereof. Other suitable compositions for the activator include transitional metal compounds or organometallic complexes. The more efficient an ion is at coupling with the frequencies the faster the temperature rise in the system.

In one embodiment the added activator chosen would not be a substance already prevalent in the crude oil or bitumen. Substances that exhibit dipole motion that are already in the formation include water, salt, asphaltenes and other polar molecules. By injecting an activator not naturally present in the system, it not only permits the operator to establish the exact frequency required to activate the activator but it permits the operator the knowledge of how to eliminate the activator afterwards.

Methods of eliminating the activator include chealation, adsorption, crystallization, distillation, evaporation, flocculation, filtration, precipitation, sieving, sedimentation and other known separation methods. All these methods are enhanced when one skilled in the art are able to ascertain the exact chemical that one is attempting to purge from a solution.

One skilled in the art would also be able to select a specific activator that does not need to be eliminated from the solution. One such example of an activator that can remain in crude oil includes activated carbon or graphite particles In one embodiment a predetermined amount of activators, comprising of metal ion salts, are injected into the production well via a solution. Frequency generators are then operated to generate non-microwave frequencies capable of causing maximum excitation of the activators. For some embodiments, the frequency generator defines a variable frequency source of a preselected bandwidth sweeping around a central frequency. As opposed to a fixed frequency source, the sweeping by the frequency generator can provide time-averaged uniform heating of the hydrocarbons with proper adjustment of frequency sweep rate and sweep range to encompass absorption frequencies of constituents, such as water and the non-microwave energy absorbing substance, within the mixture. In some embodiments the microwave frequency will be not greater than 3000 megahertz and/or at a resonant frequency of water. At lower frequencies the wavelength is longer and can therefore travel farther into the subsurface and the resultant heavy oil bitumen. Optionally, frequency generators can be utilized to excite pre-existing substances in the aqueous formation that contain existing dipole moments. Examples of these pre-existing substances include: water or salt water used in SAGD or ES-SAGD operations, asphaltene, heteroatoms and metals.

In an alternate embodiment multiple activators with differing peak excitation levels can be dispersed into the production well. In such an embodiment one skilled in the art would be capable of selecting the preferred range of radio frequencies to direct into the activators to achieve the desired temperature range.

In one embodiment the activators provide all the heat necessary to upgrade the oil in the production well. In an alternate embodiment it is also possible that the activator supplements preexisting heating methods in the production well. In yet another embodiment the heat generated by the activators will be sufficient to produce upgrading of the heavy oil in-situ in the production well. In this instance the upgrading of the heavy oil will supplement the upgrading provided by the catalyst.

For example three different activators with three distinct frequencies are injected along the vertical length of the production well. With three different activators the amount of rotational mechanism achieved through each would vary, therefore the temperature in the production well would be different dependant upon the specific activator activated. One skilled in the art would be capable of generating a specific ideal temperature range in the wellbore by selectively operating the frequency generators to activate the appropriate activators to obtain desired temperature range.

The activators can be injected into the wellbore through a variety of methods as commonly known in the art. Examples of typical methods known in the art include injecting the activators via aqueous solution.

The activators are able to heat the heavy oil/bitumen via conductive and convective mechanisms by the heat generation of the activators. The amount of heat generated could break the large molecules in the heavy oil/bitumen into smaller molecules and hence decrease the viscosity permanently.

Frequencies come from the frequency generators can be situated either above or below ground. The antennas should be directed towards the activators and can be placed either above ground, below ground or a combination of the two. It is the skill of the operator to determine the optimal placement of the radio antenna to target a particular activator to achieve dipole moment vibration while still maintaining ease of placement of the antennas.

In yet another embodiment the oil to be upgraded inside the wellbore is obtained from an enhanced steam assisted gravity drainage method. In such a method since a preexisting activator is already present it eliminates the need to inject additional activators. A frequency antenna is directed into the wellbore, the activator is excited with frequencies which is followed by upgrading the oil inside the production well with the excited activator.

The addition of the catalyst aids in the upgrading of the heavy oil. In one embodiment the catalyst is injected into the wellbore. In another embodiment the catalyst is injected into the wellbore and the subterranean region. In yet another embodiment the catalyst is injected only into the subterranean region. In each of these embodiments the placement of the catalyst will induce the upgrading in the vicinity of the injection area and continue upgrading as the catalyst moves along the steam assisted gravity drainage operation. The injection of the catalyst can occur through any known injection method in the art.

The catalyst is used to either hydrogenate or desulfurize the heavy oil. Any known catalyst in the art capable of hydrogenating or desulfurizing the heavy oil to induce upgrading can be utilized. In one embodiment the catalyst injected into the wellbore, the subterranean region or both the wellbore and the subterranean region. It is possible for the catalyst to be a liquid catalyst that is either oil soluble or water soluble. It is preferred that the catalyst is an organometallic complex. The organometallic complex can comprise either one or a combination of a group 6, 7, 8, 9 or 10 metal from the periodic table. More preferably the metal complex comprises nickel, manganese, molybdenum, tungsten, iron or cobalt. In yet another embodiment it is preferred that the catalyst is a peroxide, one example of such a peroxide is hydrogen peroxide.

Other embodiments of hydrogenation catalysts include active metals that specifically have a phosphorus chemical shift value in $^{31}$P-CPMAS-NMR, the peak of which is in the range of preferably 0 to −20 ppm, more preferably −5 to −15 ppm, and even more preferably −9 to −11 ppm. Other embodiments of desulfurization catalysts include those that have hydrogenation functionality.

In operation, steam generated in boiler 11 is provided into the reservoir 12 through upper wellbore leg 16. The steam and the heated activator heats the heavy oil within zone 17 of the oil-bearing portion 13 of reservoir 12 causing it to become less viscous and, hence, increase its mobility. The heated heavy oil flows downward by gravity and is produced through wellbore leg 14. While FIG. 1 illustrates a single wellbore for injection and a single wellbore for extraction, other configurations are within the scope of the invention, for example, there can be two or more separate wellbores to provide steam and activator injection and two or more separate wellbores for production. Similarly, multiple wellbores can be used for microwave introduction to the reservoir, as further discussed below.

Generally, the wellbore for steam and activator injection, wellbore 16, will be substantially parallel to and situated above the wellbore for production, wellbore 14, which is located horizontally near the bottom of the formation. Pairs of steam and activator injection wellbores and production wellbores will generally be close together and located at a suitable distance to create an effective steam chamber and yet minimizing the preheating time. Typically, the pairs of injection and production wellbores will be from about 3 meters to 7 meters apart and preferably there will be about 5 meters of vertical separation between the injector and producer wellbores. In other embodiments it is possible for the injection and production wellbores be anywhere from 1, 3, 5, 7, 12, 15, 20 even 25 meters of horizontal separation apart. Additionally, in other embodiments it is possible for the injection and production wellbores be anywhere from 1, 3, 5, 7, 12, 15, 20 even 25 meters of vertical separation apart. In this type of SAGD operation, the zone 17 is preheated by steam circulation until the reservoir temperature between the injector and producer wellbore is at a temperature sufficient to drop the viscosity of the heavy oil so that it has sufficient mobility to flow to and be extracted through wellbore 14. Generally, the heavy oil will need to be heated sufficiently to reduce its viscosity to below 3000 cP; however, lower viscosities are better for oil extraction and, thus, it is preferable that the viscosity be below 1500 cP and more preferably below 1000 cP. Preheating zone 17 involves circulating steam inside a liner using a tubing string to the toe of the wellbore. Both the injector and producer would be so equipped. Steam and activator circulation through wellbores 14 and 16 will occur over a period of time, typically about 3 months. During the steam and activator circulation, heat is conducted through the liner wall into the reservoir near the liner. At some point before the circulation period ends, the temperature midway between the injector and producer will reach a temperature wherein the bitumen will become movable typically around 3000 cP or less or from about 80 to 100° C. Once this occurs, the steam and activator circulation rate for wellbore 14 will be gradually reduced while the steam and activator rate for the injector wellbore 16 will be maintained or increased. This imposes a pressure gradient from high, for the area around wellbore 16, to low, for the area around wellbore 14. With the oil viscosity low enough to move and the imposed pressure differential between the injection and production wellbores, steam (usually condensed to hot water) starts to flow from the injector into the producer. As the steam and activator rate is continued to be adjusted downward in wellbore 14 and upward in wellbore 16, the system arrives at steam assisted gravity drainage operation with no steam and activator injection through wellbore 14 and all the steam and activator injection through wellbore 16. Once hydraulic communication is established between the pair of injector and producer wellbores, steam and activator injection in the upper well and liquid production from the lower well can proceed. Due to gravity effects, the steam vapor tends to rise and develop a steam chamber at the top section 19 of zone 17. The process is operated so that the liquid/vapor interface is maintained between the injector and producer wellbores to form a steam trap which prevents live steam from being produced through the lower wellbore.

During operation, steam and heated activators will come into contact with the heavy oil in zone 17 and, thus, heat the heavy oil and increase its mobility by lessening its viscosity. Heated heavy oil will tend to flow downward by gravity and collect around wellbore 14. Heated heavy oil is produced through wellbore 14 as it collects. Steam contacting the heavy oil will lose heat and tend to condense into water. The water will also tend to flow downward toward wellbore 14. In past SAGD operations, this water would also be produced through wellbore 14. Such produced water would need to be treated to reduce impurities before being reheated in the boiler for subsequent injection. As the process continues operation, zone 17 will expand with heavy oil production occurring from a larger portion of oil-bearing portion 13 of subterranean formation 12.

Turning again to FIG. 1, the current invention provides for microwave generator 18 to generate microwaves which are directed underground and into zone 17 of the reservoir through a series of wave guides 20. The diameter of the wave guides will preferably be more than 3 inches in order to ensure good transmission of the microwaves. Within the reservoir, the microwaves will be at a frequency substantially equivalent to the resonant frequency of the water within the reservoir so that the microwaves excite the water molecules causing them to heat up. Optimally, the microwaves will be introduced at or near the liquid vapor interface so that condensed steam is reheated from its water state back into steam further supplying the steam chamber. In some embodiments the microwave frequency will be not greater than 3000 megahertz and/or at a resonant frequency of water. Based on the resonant frequency of water, the optimum frequency will be 2450 megahertz; however, power requirements and other factors may dictate that another frequency is more economical. Additionally, salt and other impurities may enhance the coupling effect (production of heat by resonance of a polar or conductive molecule with microwave energy); thus, the presence of salt is desirable.

Figure 2:
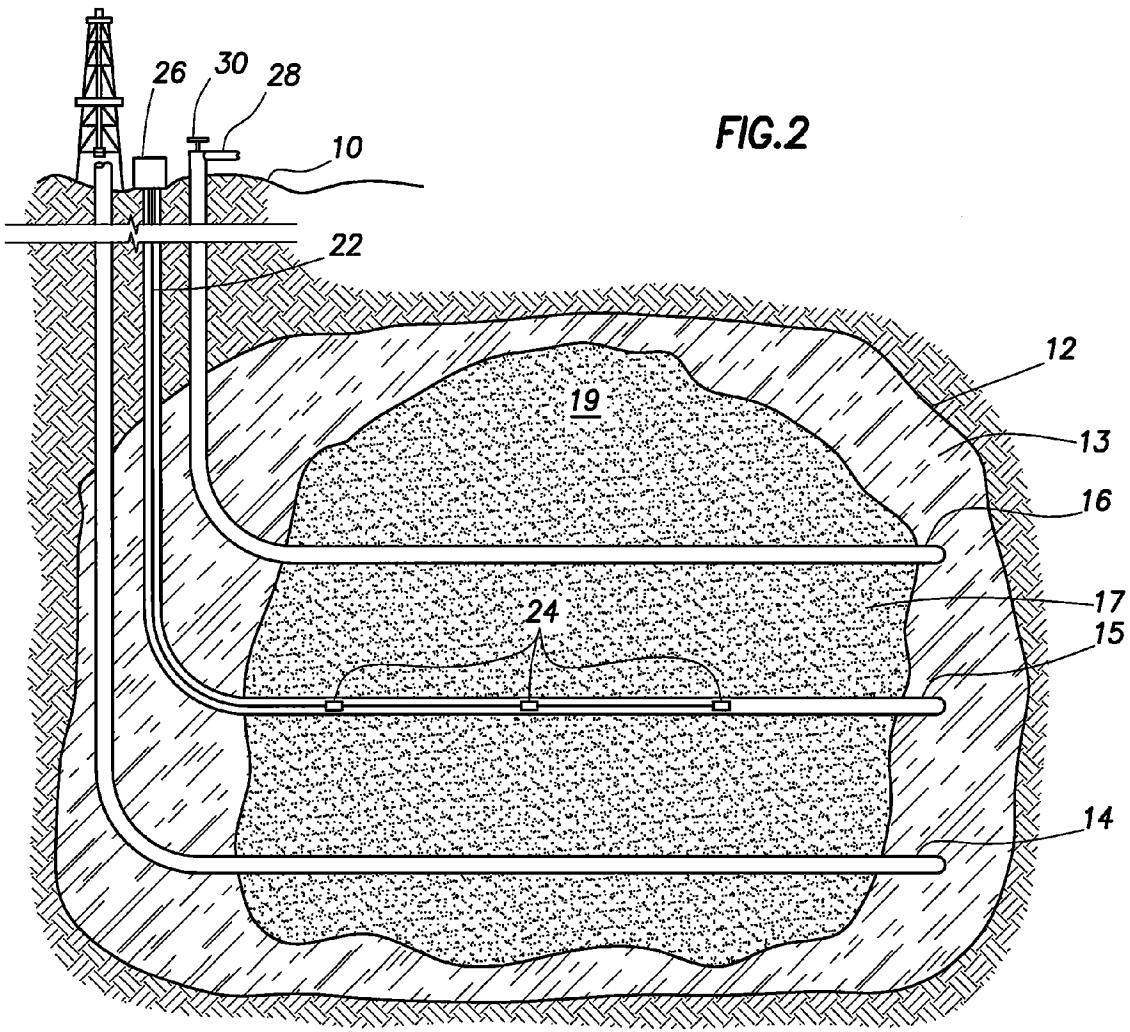
FIG. 2 is a schematic diagram illustrating a heavy oil heating process wherein the microwaves are introduced into the reservoir using a microwave generator located within the reservoir.

Turning now to FIG. 2, a further embodiment of the invention is illustrated wherein, instead of using wave guides, power is supplied through electrical wire 22 to microwave generating probe 24. The electrical power can be supplied to wire 22 by any standard means such as generator 26.

In still another embodiment of the invention, also illustrated in FIG. 2, no steam boiler is used. Instead water is introduced directly into wellbore 16 through pipe 28 and valve 30. Wellbore 16 then introduces water into the reservoir instead of steam and the entire steam production would be accomplished through use of the microwave generators. This embodiment of the invention has the added advantage of avoiding costly water treatment that is necessary when using a boiler to generate steam because, as discussed above, salt and other impurities can aid in heat generation. In a preferred embodiment, the water introduced into the reservoir would have a salt content greater than the natural salt content of the reservoir, which is typically about 5,000 to 7,000 ppm. Accordingly, it is preferred that the introduced water has a salt content greater than 10,000 ppm. For enhanced heat generation 30,000 to 50,000 ppm is more preferred.

Figure 3:
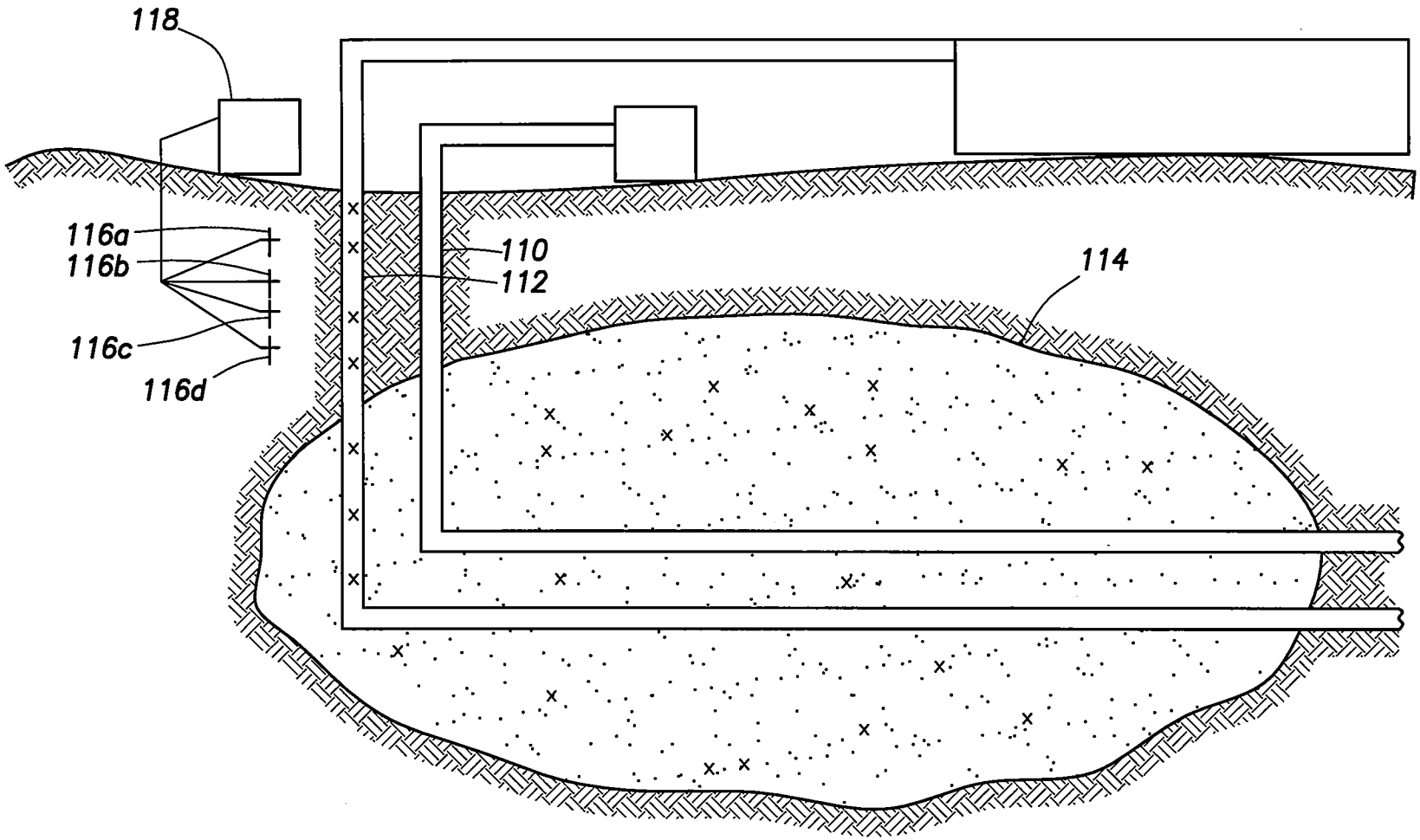
FIG. 3 depicts a method of utilizing activators in a SAGD system to heat the heavy oil.

In a non-limiting embodiment, FIG. 3 depicts a method of utilizing activators in a SAGD system to heat the heavy oil. Normally, the activator can be injected into the wellbore using any method typically known in the art. In this embodiment the activator is placed downhole either via the first wellbore 110 or the second wellbore 112. In this embodiment the activator is depicted with the symbol "x". Once the activators are in the stratum 114, antenna 116*a*, 116*b*, 116*c* and 116*d*, which are attached to a frequency generator 118, are used to heat the activators in the second wellbore 112. In other embodiments two or more frequencies are generated such that one range excites the activator and/or water and the other range excites the existing constituents of the heavy oil and/or water.

Figure 4:
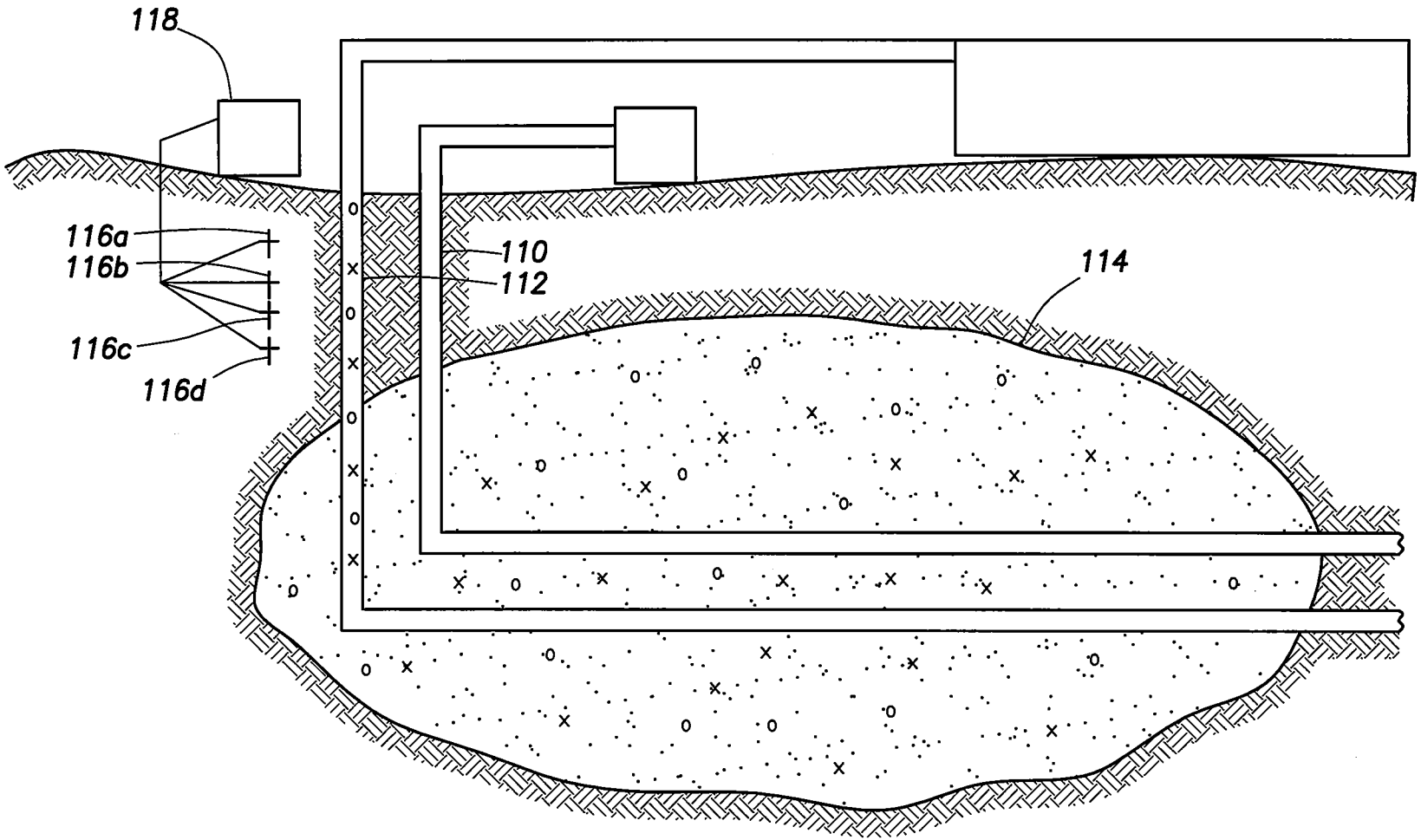
FIG. 4 depicts a method of utilizing activators in a SAGD system to heat the heavy oil while upgrading the oil with activators.

In yet another non-limiting embodiment, FIG. 4 depicts a method of utilizing a method of heating activators in a SAGD system while upgrading the heavy oil with a catalyst. The catalyst can be injected into the formation using any method typically known in the art. In this embodiment the catalyst is depicted with the symbol "o". In this embodiment the activator is placed downhole either via the first wellbore 110 or the second wellbore 112. In this embodiment the activator is depicted with the symbol "x". Once the activators are in the stratum 114, antenna 116*a*, 116*b*, 116*c* and 116*d*, which are attached to a frequency generator 118, are used to heat the activators in the second wellbore 112.

Microwave generators useful in the invention would be ones suitable for generating microwaves in the desired frequency ranges recited above. Microwave generators and wave guide systems adaptable to the invention are sold by Cober Muegge LLC, Richardson Electronics and CPI International Inc.

Steam to oil ratio is an important factor in SAGD operations and typically the amount of water required will be 2 to 3 times the oil production. Higher steam to oil production ratios require higher water and natural gas costs. The present invention reduces water and natural gas requirements and reduces some of the water handling involving recycling, cooling, and cleaning up the water.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A process comprising:

(a) injecting $H_2O$ and an activator into a subterranean region through a first wellbore of a steam assisted gravity drainage operation;

(b) introducing microwaves into the region at a frequency sufficient to excite the $H_2O$ and activator molecules and increase the temperature of at least a portion of the $H_2O$ and activator within the region to produce heated $H_2O$ and heated activator;

(c) heating at least a portion of the heavy oil in the region by contact with the heated $H_2O$ and the heated activator to produce heated heavy oil; and (d) producing the heated heavy oil through a second wellbore of the steam assisted gravity drainage operation;

thereby recovering heavy oil with the steam assisted gravity drainage operation from the subterranean region;

wherein a portion of the $H_2O$ is injected as steam and the steam contacts with at least a portion of the heavy oil in the region so as to heat the portion of the heavy oil and reduce its viscosity so that it flows generally towards the second wellbore.

2. The process of claim 1 wherein at least a portion of the steam condenses to a liquid state to form water as a result of its contact with the heavy oil and wherein the frequency excite the molecules of at least a portion of the water so that the water is heated and becomes steam.

3. The process of claim 2 wherein the frequencies are generated at the surface and introduced into the region through at least one waveguide.

4. The process of claim 3, wherein the frequency is less than or equal to 3000 MHz.

5. The process of claim 4 wherein the frequencies are generated within the region.

6. The process of claim 5 wherein the frequencies are less than or equal to 3000 MHz.

7. The process of claim 1 further comprising injecting at least a portion of the $H_2O$ as water and wherein the frequencies excite the molecules of at least a portion of the thus injected water so that the water is heated and becomes steam.

8. The process of claim 7 wherein the thus injected water has a salt content of at least 10,000 ppm.

9. The process of claim 7 wherein the steam contacts at least a portion of the heavy oil in the region so as to heat the heavy oil and reduce its viscosity so that it flows generally towards the second wellbore.

10. The process of claim 9, wherein the activator comprises at least one of $AlCl_4^-$, $FeCl_4^-$, $NiCl_3^-$ and $ZnCl_3^-$.

11. The process of claim 7 wherein at least a portion of the steam condenses to a liquid state to form water as a result of its contact with the heavy oil and wherein the frequencies excite the molecules of at least a portion of the thus formed water so that the water is heated and becomes steam.

12. The process of claim 11 further comprising injecting at least a portion of the $H_2O$ as water in step (a).

13. The process of claim 12 wherein the thus injected water has a salt content of at least 10,000 ppm.

14. The process of claim 12 wherein the frequencies are generated at the surface and introduced into the region through at least one waveguide.

15. The process of claim 14, wherein the frequencies are less than or equal to 3000MHz.

16. The process of claim 12 wherein the frequencies are generated within the region.

17. The process of claim 16 wherein the frequencies are less than or equal to 3000 MHz.

18. The process of claim 1, wherein the frequency is regulated to the range necessary to excite the activator.

19. The process of claim 1, wherein two or more frequencies are generated such that one range excites the activator and the other range excites existing constituents in the heavy oil.

20. The process of claim 1, wherein the activator is a halide compound.

21. The process of claim 1, wherein the activator is a metal containing compound.

22. The process of claim 1, wherein the halide compound comprises a metal from period 3 or period 4 of the periodic table.

23. The process of claim 1, wherein the frequency ranges from 0.1 MHz to 300 MHz.

24. A process comprising:

(a) injecting liquid $H_2O$ and an activator into a region through a first wellbore of a steam assisted gravity drainage operation;

(b) introducing a frequency less than 3,000 MHz into a subterranean region at a frequency sufficient to excite the liquid $H_2O$ molecules and activator molecules and increase the temperature of at least a portion of the liquid $H_2O$ and activator within the region to produce heated gaseous $H_2O$ and heated activator;

(c) heating at least a portion of the heavy oil in the region by contact with the heated gaseous $H_2O$ and the heated activator to produce heated heavy oil; and (d) producing the heated heavy oil through a second wellbore of the steam assisted gravity drainage operation;

thereby recovering heavy oil with the steam assisted gravity drainage operation from the subterranean region;

wherein a portion of the liquid $H_2O$ is injected as steam and the steam contacts with at least a portion of the heavy oil in the region so as to heat the portion of the heavy oil and reduce its viscosity so that it flows generally towards the second wellbore and wherein a catalyst is injected into the region such that the catalyst contacts the heated heavy oil thereby producing an upgraded heavy oil.

25. The process of claim 24, wherein the catalyst is a hydrogenation catalyst, a desulfurization catalyst or combination.

26. The process of claim 24, wherein the upgrading of the heavy oil causes some of the molecules of the hydrocarbons to be converted into smaller molecules.

27. The process of claim 24, wherein the catalyst is a liquid catalyst.

28. The process of claim 24, wherein the catalyst is an organometallic complex.

29. The process of claim 24, wherein organometallic complex comprises a group 6, 7, 8, 9 or 10 metal from the periodic table.

30. The process of claim 24, wherein the catalyst is a peroxide.

31. A process comprising:

(a) injecting $H_2O$ and an activator into a subterranean region through an injection wellbore of a steam assisted gravity drainage operation;

(b) introducing a frequency less than 3,000 MHz into the region at a frequency sufficient to excite the $H_2O$ and activator molecules and increase the temperature of at least a portion of the $H_2O$ and activator within the region to produce heated $H_2O$ and heated activator;

(c) heating at least a portion of the bitumen to below 3000 cp in the region by contact with the heated $H_2O$ and the heated activator to produce a heated heavy oil and a imposed pressure differential between the injection wellbore and a production wellbore; and (d) producing the heated heavy oil through the production wellbore of the steam assisted gravity drainage operation;

thereby recovering heavy oil with the steam assisted gravity drainage operation from the subterranean region wherein the injection wellbore and the production wellbore are from 3 meters to 7 meters apart and the injection wellbore is located higher than the production wellbore;

wherein the $H_2O$ is injected as steam and the steam contacts with at least a portion of the heavy oil in the region so as to heat the portion of the heavy oil and reduce its viscosity so that it flows generally towards the second wellbore and wherein a catalyst is injected into the region such that the catalyst contacts the heated heavy oil thereby producing an upgraded heavy oil.

* * * * *